US010759653B1

(12) United States Patent
Jasek

(10) Patent No.: US 10,759,653 B1
(45) Date of Patent: Sep. 1, 2020

(54) LIQUID FUEL SPOUT ASSEMBLIES

(71) Applicant: Sidney Jasek, Hallettsville, TX (US)

(72) Inventor: Sidney Jasek, Hallettsville, TX (US)

( * ) Notice: Subject to any disclaimer, the term of this patent is extended or adjusted under 35 U.S.C. 154(b) by 0 days.

(21) Appl. No.: 16/703,502

(22) Filed: Dec. 4, 2019

(51) Int. Cl.
*B67D 7/36* (2010.01)
*B67D 7/42* (2010.01)

(52) U.S. Cl.
CPC ..... *B67D 7/36* (2013.01); *B67D 7/42* (2013.01)

(58) Field of Classification Search
CPC .. B67D 7/36; B67D 7/42; B67D 7/005; F16K 11/02
USPC ..... 222/481.5
See application file for complete search history.

(56) References Cited

U.S. PATENT DOCUMENTS 2,183,032 A * 12/1939 Roycroft ..... F16K 35/025 74/526
2,257,895 A * 10/1941 Woodford ..... B67D 7/42 137/801
4,016,684 A * 4/1977 Urda ..... F16P 3/00 451/344
4,254,667 A * 3/1981 Wong ..... G05G 1/04 173/170
5,350,091 A 9/1994 Leete
5,765,609 A * 6/1998 Dalhart ..... B67D 7/42 138/113
8,573,452 B2 11/2013 Whitcomb
8,602,273 B2 12/2013 Carter
8,863,997 B2 11/2014 Hickey
9,415,994 B2 8/2016 Ouderkirk
1,027,313 A1 2/2018 Garrison et al.
1,007,714 A1 9/2018 Boucher et al.
1,027,305 A1 4/2019 Hoffman
1,028,006 A1 5/2019 Shaw
2017/0327281 A1 11/2017 Cross
2017/0369206 A1 12/2017 Bermingham
2018/0327250 A1 11/2018 Boucher et al.

* cited by examiner

*Primary Examiner* — Nicholas J. Weiss
(74) *Attorney, Agent, or Firm* — Elliott & Polasek, PLLC; Douglas H. Elliott; Nathan Q. Huynh

(57) ABSTRACT

Disclosed herein are spout assemblies including a spout assembly for pouring liquid fuel, which spout assembly may include a valve body, a valve stem, and a nozzle, in which: the valve body may include: an air flow housing defining an air flow path; a liquid flow housing defining a liquid flow path; and a valve stem housing that includes a valve stem wall defining a valve stem path, the valve stem wall may include: a liquid port capable of liquid communication with the liquid flow path; and an air port capable of fluid communication with the air flow path; the valve stem may be disposed in the valve stem path, and may include: a first stem flange capable of inhibiting air flow from the air flow path to the valve stem path; a second stem flange capable of inhibiting liquid flow from the liquid flow path to the valve stem path; and the nozzle may be coupled to the valve body.

4 Claims, 11 Drawing Sheets

LIQUID FUEL SPOUT ASSEMBLIES

BACKGROUND

1. Field of Inventions

The field of this application and any resulting patent is liquid fuel spout assemblies.

2. Description of Related Art

Various liquid fuel spout assemblies and methods for pouring liquid fuel have been proposed and utilized, including some of the methods and structures disclosed in some of the references appearing on the face of this patent. However, those methods and structures lack the combination of steps and/or features of the methods and/or structures disclosed herein. Furthermore, it is contemplated that the methods and/or structures disclosed herein solve many of the problems that prior art methods and structures have failed to solve. Also, the methods and/or structures disclosed herein have benefits that would be surprising and unexpected to a hypothetical person of ordinary skill with knowledge of the prior art existing as of the filing date of this application.

SUMMARY

The disclosure herein includes a spout assembly for pouring liquid fuel, which spout assembly may include a valve body, a valve stem, and a nozzle, wherein: the valve body may include: an air flow housing defining an air flow path; a liquid flow housing defining a liquid flow path; and a valve stem housing that includes a valve stem wall defining a valve stem path, the valve stem wall may include: a liquid port capable of liquid communication with the liquid flow path; and an air port capable of fluid communication with the air flow path; the valve stem may be disposed in the valve stem path, and may include: a first stem flange capable of inhibiting air flow from the air flow path to the valve stem path; a second stem flange capable of inhibiting liquid flow from the liquid flow path to the valve stem path; and the nozzle may be coupled to the valve body.

The disclosure herein includes a spout assembly for pouring liquid fuel, which spout assembly may include a valve body, a valve stem, and a nozzle, wherein: a) the valve body includes a first housing, a second housing, and a valve stem housing; b) the valve stem housing may be disposed between the first housing and the second housing and may include at least one liquid port for passage of liquid fuel between the first housing and the valve stem housing and at least one air port for passage of air between the first housing and the valve stem housing; and c) the valve stem may have a plurality of circumferential grooves, each sized to receive one of the plurality of seals, wherein the seals may be capable of inhibiting the flow of air or liquid within the valve stem housing.

The disclosure herein includes a spout assembly for pouring liquid fuel, which spout assembly may include a valve body, a valve stem, and a nozzle, wherein: a) the valve body may include a first housing, a second housing, and a valve stem housing; b) the valve stem housing may be disposed between the first housing and the second housing and includes at least one liquid port for passage of liquid fuel between the first housing and the valve stem housing and at least one air port for passage of air between the first housing and the valve stem housing; and c) the valve stem may be cylindrical and may include a plurality of valve stem portions including a first narrow valve stem portion and a second narrow valve stem portion, each of the first and second narrow valve stem portions having a diameter that may be less than the diameter of any of the other of the plurality of valve stem portions.

The disclosure herein includes a spout assembly for pouring liquid fuel, which spout assembly may include: a valve body that may include: an air flow path wall defining an air flow path; a liquid flow path wall defining liquid flow path; and a valve stem wall defining a valve stem path, the valve stem wall may include: a liquid port in fluid communication with the liquid flow path; and an air port in fluid communication with the air flow path; a valve stem disposed in the valve stem path, the valve stem may include: a first stem groove aligned with the valve stem path; a second stem groove aligned with the liquid flow path; an outer nozzle coupled to the valve body; and an inner nozzle disposed in the outer nozzle.

The disclosure herein includes a method of pouring liquid fuel, which method may include: providing a spout assembly that may include a valve body, a valve stem, and a nozzle, wherein: 1) the valve body may include: a) an air flow housing defining an air flow path; b) a liquid flow housing defining a liquid flow path; and c) a valve stem housing that includes a valve stem wall defining a valve stem path, which valve stem wall may include: i) a liquid port capable of liquid communication with the liquid flow path, and ii) an air port capable of fluid communication with the air flow path; 2) the valve stem may be disposed in the valve stem path, and may include: a) a first stem flange capable of inhibiting air flow from the air flow path to the valve stem path; b) a second stem flange capable of inhibiting fluid flow from the liquid flow path to valve stem flow path; and 3) the nozzle may be coupled to the valve body.

The disclosure herein includes a method of pouring liquid fuel, which method may include: providing a spout assembly that may include a valve body, a valve stem, and a nozzle, wherein: 1): the valve body may include a first housing, a second housing, and a valve stem housing; 2) the valve stem housing may be disposed between the first housing and the second housing and includes at least one liquid port for passage of liquid fuel between the first housing and the valve stem housing and at least one air port for passage of air between the first housing and the valve stem housing; and 3) the valve stem may have a plurality of circumferential grooves, each sized to receive one of the plurality of seals, wherein the seals are capable of inhibiting the flow of air or liquid within the valve stem housing.

The disclosure herein includes a method of pouring liquid fuel, which method may include: providing a spout assembly that may include a valve body, a valve stem, and a nozzle, wherein: 1) the valve body may include a first housing, a second housing, and a valve stem housing; 2) the valve stem housing may be disposed between the first housing and the second housing and includes at least one liquid port for passage of liquid fuel between the first housing and the valve stem housing and at least one air port for passage of air between the first housing and the valve stem housing; and 3) may be cylindrical and may include a plurality of valve stem portions including a first narrow valve stem portion and a second narrow valve stem portion, each of the first and second narrow valve stem portions having a diameter that may be less than the diameter of any of the other of the plurality of valve stem portions.

The disclosure herein includes a method of pouring liquid fuel, which method may include: providing a spout assembly, which valve body may include: an air flow path wall defining an air flow path; a liquid flow path wall defining liquid flow path; and a valve stem wall defining a valve stem path, the valve stem wall may include: a liquid port in fluid communication with the liquid flow path; and an air port in fluid communication with the air flow path; a valve stem disposed in the valve stem path, the valve stem may include: a first stem groove aligned with the valve stem path; a second stem groove aligned with the liquid flow path; an outer nozzle coupled to the valve body; and an inner nozzle disposed in the outer nozzle.

DETAILED DESCRIPTION

1. Introduction

Figure 1A:
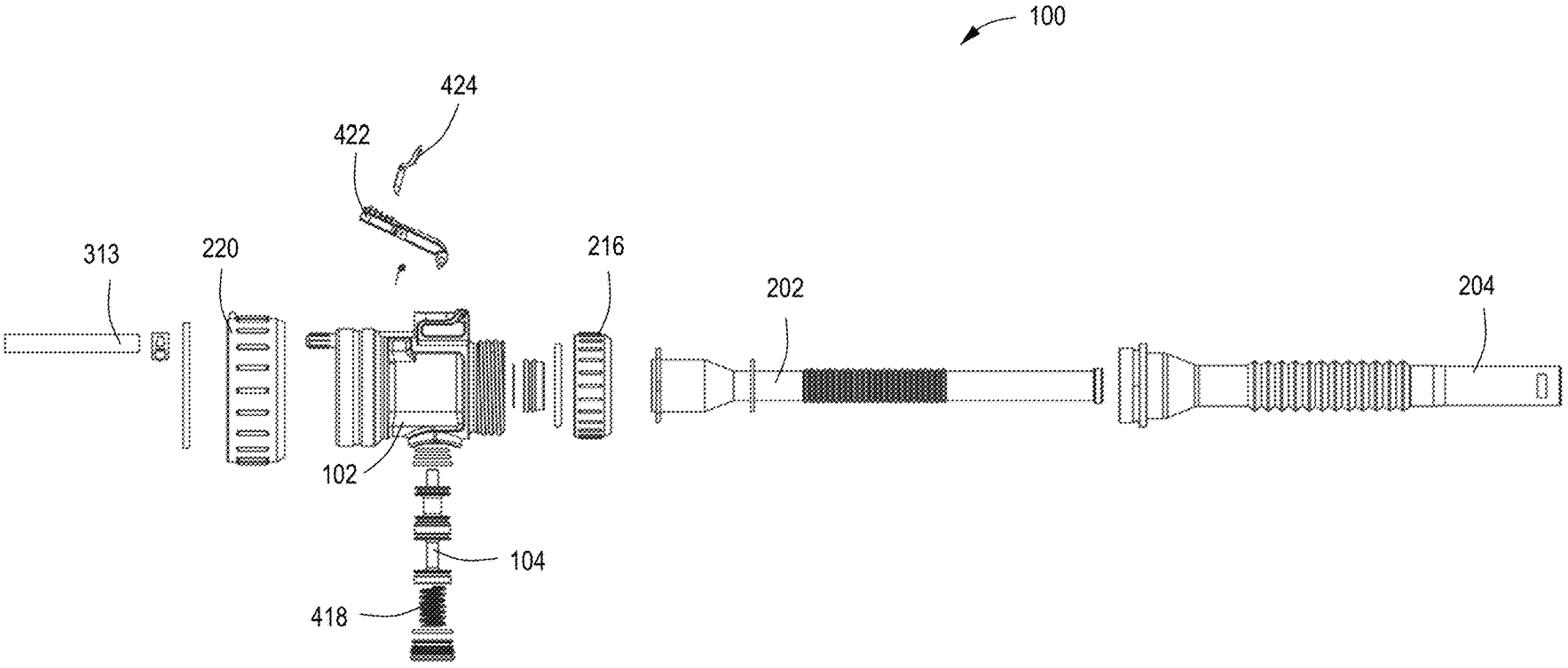
FIG. 1A illustrates an exploded view of a spout assembly.

A detailed description will now be provided. The purpose of this detailed description, which includes the drawings, is to satisfy the statutory requirements of 35 U.S.C. § 112. For example, the detailed description includes a description of inventions defined by the claims and sufficient information that would enable a person having ordinary skill in the art to make and use the inventions. In the figures, like elements are generally indicated by like reference numerals regardless of the view or figure in which the elements appear. The figures are intended to assist the description and to provide a visual representation of certain aspects of the subject matter described herein. The figures are not all necessarily drawn to scale, nor do they show all the structural details, nor do they limit the scope of the claims.

Each of the appended claims defines a separate invention which, for infringement purposes, is recognized as including equivalents of the various elements or limitations specified in the claims. Depending on the context, all references below to the "invention" may in some cases refer to certain specific embodiments only. In other cases, it will be recognized that references to the "invention" will refer to the subject matter recited in one or more, but not necessarily all, of the claims. Each of the inventions will now be described in greater detail below, including specific embodiments, versions, and examples, but the inventions are not limited to these specific embodiments, versions, or examples, which are included to enable a person having ordinary skill in the art to make and use the inventions when the information in this patent is combined with available information and technology. Various terms as used herein are defined below, and the definitions should be adopted when construing the claims that include those terms, except to the extent a different meaning is given within the specification or in express representations to the Patent and Trademark Office (PTO). To the extent a term used in a claim is not defined below or in representations to the PTO, it should be given the broadest definition persons having skill in the art have given that term as reflected in at least one printed publication, dictionary, or issued patent.

2. Selected Definitions

Certain claims include one or more of the following terms which, as used herein, are expressly defined below.

The term "adjacent" as used herein means next to and may include physical contact but does not require physical contact.

The term "abut against" as used herein as a verb is defined as position adjacent to and either physically touch or press against, directly or indirectly. After any abutting takes place with one object relative to another object, the objects may be fully or partially "abutted." For example, a first object may be abutted against a second object such that the second object is limited from moving in a direction of the first object. Thus, a lever may be abutted against a trigger end of a valve stem.

The term "aligning" as used herein is a verb that means manufacturing, forming, adjusting, or arranging one or more physical objects into a particular position. After any aligning takes place, the objects may be fully or partially "aligned." Aligning preferably involves arranging a structure or surface of a structure in linear relation to another structure or surface; for example, such that their borders or perimeters may share a set of parallel tangential lines. In certain instances, the aligned borders or perimeters may share a similar profile. Additionally, apertures may be aligned, such that a structure or portion of a structure may be extended into and/or through the apertures.

The term "aperture" as used herein is defined as any opening in a solid object or structure, e.g., valve body, valve stem, nozzle, or cap. For example, an aperture may be an opening that begins on one side of a solid object and ends on the other side of the object. An aperture may alternatively be an opening that does not pass entirely through an object, but only partially passes through, e.g., as a groove. An aperture can be an opening in an object that is completely circumscribed, defined, or delimited by the object itself. Alternatively, an aperture can be an opening formed when one object is combined with one or more other objects or structures. An aperture may receive an object, e.g., portion of a valve stem, pin, cap, fluid, liquid, or air. For example, a valve stem may be received in an aperture of a valve body.

The term "assembly" as used herein is defined as any set of components that have been fully or partially assembled together. A group of assemblies may be coupled to form a solid housing having an inner surface and an outer surface.

The term "corrugated" as used herein is defined as having a ridge or fold on a surface.

The term "coupled" as used herein is defined as directly or indirectly connected or attached. A first object may be coupled to a second object such that the first object is positioned at a specific location and orientation with respect to the second object. For example, a motor may be coupled to a cutter assembly. A first object may be either permanently, removably, slidably, threadably, rotatably coupled to a second object. Two objects are permanently coupled, if once they are coupled, the two objects, in some cases, could not be separated. Two objects may be removably coupled to each other via shear pins, threads, tape, latches, hooks, fasteners, locks, male and female connectors, clips, clamps, knots, and/or surface-to-surface contact. For example, a valve stem and a valve body may be removably coupled to each other such that the valve stem may then be uncoupled and removed from the valve body. Two objects may be slidably coupled together, where an inner aperture of one object is capable of receiving a second object. For example, a valve stem may be slidably coupled to a valve body. Additionally, two objects may be capable of being threadably coupled, e.g., where a threaded outer surface of one object is capable of being engaged with or to a threaded inner surface of another object. Threadably coupled objects may be removably coupled. Accordingly, a cap may be threadably coupled to a valve body where a threaded inner surface, e.g., box threads or female threads, of the cap may be engaged with a threaded outer surface, e.g., pin threads or male threads, of the valve body. Two objects may be rotatably coupled when a first object is directly or indirectly connected with a second object and one of the objects remains free to rotate and/or pivot relative to the other. A first object rotatably coupled to a second object may rotate around a central axis of the second object. A first object rotatably coupled to a second object may spherically rotate in multiple directions relative to the second object. A first object rotatably coupled to a second object may pivot on the central axis or point of the second object. For example, a lever may be rotatably, e.g., pivotably, coupled to a valve body, as depicted FIGS. 4A-B.

The term "cylindrical" as used herein is defined as shaped like a cylinder, e.g., having straight parallel sides and a circular or oval or elliptical cross-section. Examples of cylindrical structures or objects may include a valve body, a valve stem, and nozzle. A cylindrical object may be completely or partially shaped like a cylinder. For example, a cylindrical object may have an aperture that is extended through the entire length of the housing to form a hollow cylinder capable of permitting another object, e.g., valve body and nozzle, to be extended or passed through. Alternatively, a solid cylindrical object may have an inner surface or outer surface having a diameter that changes abruptly. A cylindrical object may have and inner or outer surface having a diameter that changes abruptly to form a collar, e.g., flange, radial face, rim, or lip. A cylindrical object may have a collar extending toward the central axis line of the object. A cylindrical object may have a collar disposed on an inner surface. A cylindrical object may have a flange extending away from the central axis line of the object. A cylindrical object may have a flange disposed on an outer surface. Additionally, a cylindrical object, may have a collar or a flange that is tapered or radiused.

The terms "first" and "second" as used herein merely differentiate two or more things or actions, and do not signify anything else, including order of importance, sequence, etc.

The term "flow path" as used herein is defined as a space through which fluid is capable of flowing, e.g., a conduit, preferably a conduit that is defined by surfaces of a wall. A flow path may be disposed within an object, e.g., a valve body, a nozzle, a tube, a cylindrical structure, a housing, a tube and/or a spout assembly. A flow path may extend uninterrupted through an object, e.g., from one end of the object to another end. A flow path may be formed by a groove disposed on an object. A flow path may be a groove disposed in an outer surface of an object. A flow path may be formed by one or more inner surfaces of an object, e.g., of a valve body. A flow path may be formed by the inner surfaces of a group of coupled objects, e.g., two or more housings and/or a spout assembly. A flow path may be formed from two or more connected flow paths that may intersect one another.

The term "flow rate" as used herein is defined as the volume of material or fluid that passes per unit of time. Volume may be measured in gallons or liters. Time may be measured in seconds, minutes, or hours.

The term "fluid" as used herein is defined as material that is capable of being flowed. A fluid may be a liquid or a gas. Examples of a fluid may include hydrocarbon, gasoline, kerosene, water, lubricant, cleaning fluid, and motor oil. A fluid can be a mixture of two or more fluids. A fluid may absorb heat. A fluid may have properties such as viscosity, anti-foaming, thermal stability, thermal conductivity, and thermal capacity. A fluid may be water-based, oil-based, synthetic, or a combination of viscous materials and solid materials.

The term "housing" as used herein is defined as a structure, preferably a cylindrical wall, configured to have fluid disposed therein. A housing may be hollow. Two or more structures, e.g., walls, coupled together may form a housing. Alternatively, one cylindrical wall having a central aperture may be a housing. A housing may be disposed within another housing. Multiple housings may be coupled to form a larger housing. Two housings may share a wall. A housing may define a flow path, e.g., air flow path and liquid flow path. A housing may have one or more apertures, e.g., ports and openings.

The term "lock" as used herein is defined as a structure configured, sized, and/or shaped for inhibiting movement of a first object relative to a second object. For example, a lock may be used inhibiting movement of a lever, relative to a valve body. A lock may inhibit movement of a first object in one or more directions, e.g., radially and/or axially. A lock may have a lock end abutted against a portion of a valve body. A lock may be disposed parallel to a valve body.

The term "perpendicular" as used herein is defined as at an angle ranging from 85° or 88 to 92° or 95°. Two structures that are perpendicular to each other may be orthogonal and/or tangential to each other.

The term "port" as used herein is defined as an aperture in a structure for providing ingress and/or egress of fluid therethrough. A port may be disposed in a valve stem housing of a valve body (see 316 and 318, FIG. 3A), e.g. in a valve stem wall. Examples of ports include a liquid port and an air port.

The term "pressure" as used herein is defined as force exerted against a surface of an object, e.g., a valve stem, and when measured is done so in terms of force per unit area.

The term "providing" as used herein is defined as making available, furnishing, supplying, equipping, or causing to be placed in position.

The term "pin" as used herein is defined as structure capable of being received in an aperture or groove of another structure, e.g., for coupling two objects or inhibiting movement of an object. A pin may rotatably couple a lever to a valve body. A pin may rotatably couple a lock to a lever. A pin may be cylindrical and may have a tapered end.

The term "spout assembly" as used herein is defined as an assembly configured, sized, and shaped to provide one or more flow paths for fluid, e.g. air, liquid, fuel, gasoline, kerosene, lubricant, slurry, detergent, water, and/or viscous material, in one direction.

The term "valve stem" as used herein is defined as a structure capable of being moved within a valve body, e.g., within a valve stem housing, as illustrated in the drawings herein, from an open position, such that liquid and air can pass through the valve stem housing, to a closed position, such that liquid and air are not capable of passing through the valve stem housing, or for alternately inhibiting or permitting fluid flow depending on the position of the valve stem within the valve body. A valve stem may include a stem flange which as seen in the drawings is a portion of the valve stem with a sufficiently large diameter so that it fills up the entire inner diameter of the cylindrical valve stem housing but can slide up and down (relative to the drawings) without any substantial annular space between the outer surface of the valve stem and the inner surface of the valve stem housing. A valve stem may, for example, have a first stem flange, a second stem flange, and/or a third stem flange. For example, a valve stem may have an airflow flange that is capable of inhibiting the flow of air to the valve stem housing when the valve stem is in a closed position and a liquid flow flange that is capable of inhibiting the flow of air to the valve stem housing when the valve stem is in that same closed position. A valve stem may have one or more stem grooves, which can be disposed between two stem flanges. As seen in the drawings, the valve stem grooves are narrow valve stem portions, e.g., portions in the valve stem formed by circumferential grooves, e.g., indentations. When the valve stem is in an open position, air is capable of flowing from a first housing that includes a conduit through which air can flow, to and through an air port on one side of the valve stem housing, around one of the narrow valve stem portions of the valve stem housing that is aligned with that air port, to the other side of the valve stem housing, through another air port on the other side of the valve stem housing, and into a second housing. Similarly, when the valve stem is in that open position, liquid is capable of flowing from a first housing that includes a conduit through which liquid can flow, to and through a liquid port on one side of the valve stem housing, around another narrow valve stem portion of the valve stem housing that is aligned with that liquid port, to the other side of the valve stem housing, through another liquid port on the other side of the valve stem housing, and into the second housing. A valve stem may be solid. A valve stem may be capable of sliding relative to a valve body by application of pressure, e.g., biasing force, from a coil, e.g., a spring, or pressing by a human finger against a surface of the valve stem. A valve stem may have a stem flange having a seal disposed thereon. A stem flange may have a stem groove sized, shaped, and configured to receive a seal.

The term "surface" as used herein is defined as any face of a structure. A surface may also refer to that flat or substantially flat area that is extended radially around a cylinder which may, for example, be part of a rotor or bearing assembly. A surface may also refer to that flat or substantially flat area that extend radially around a cylindrical structure or object which may, for example, be part of a valve body, nozzle, tube, cylindrical wall, housing, tubular, and/or a spout assembly. A surface may have irregular contours. A surface may be formed from coupled components, e.g. valve body, nozzle, tube, cylindrical wall, housing, tubular, and/or a spout assembly. Coupled components may form irregular surfaces. A plurality of surfaces may be connected to form a polygonal cross-section. An example of a polygonal cross-section may be triangular, square, rectangular, pentagonal, hexagonal, or octagonal. Socket surfaces may have socket surfaces connected to form a polygonal shape, e.g., triangular, square, rectangular, pentagonal, hexagonal, or octagonal.

The term "threaded" as used herein is defined as having threads. Threads may include one or more helical protrusions or grooves on a surface of a cylindrical object. Each full rotation of a protrusion or groove around a threaded surface of the object is referred to herein as a single "thread." Threads may be disposed on any cylindrical structure or object including a valve body, nozzle, tube, cylindrical wall, housing, tubular, and/or a spout assembly. Threads formed on an inner surface of an object may be referred to as "box threads". Threads formed on an outer surface of an object may be referred to as "pin threads." A threaded assembly may include a "threaded portion" wherein a section of the threaded assembly includes threads, e.g., pin threads or box threads. A threaded portion may have a diameter sized to extend through an aperture of a cap, a housing, or a collar. In certain cases, a threaded portion of a first object may be removably coupled to a threaded portion of a second object.

The term "unitary" as used herein defined as having the form of a single unit. For example, a valve stem and a valve stem flange may be unitary if they are formed into a single piece of material, e.g., plastic, carbon fiber, ceramic, or metal.

The terms "upper," "lower," "top," "bottom" as used herein are relative terms describing the position of one object, thing, or point positioned in its intended useful position, relative to some other object, thing, or point also positioned in its intended useful position, when the objects, things, or points are compared to distance from the center of the earth. The term "upper" identifies any object or part of a particular object that is farther away from the center of the earth than some other object or part of that particular object, when the objects are positioned in their intended useful positions. The term "lower" identifies any object or part of a particular object that is closer to the center of the earth than some other object or part of that particular object, when the objects are positioned in their intended useful positions. For example, valve body, valve stem, nozzle, tube, cylindrical wall, housing, tubular, and/or a spout assembly may each have an upper end and a lower end. The term "top" as used herein means in the highest position, e.g., farthest from the ground. The term "bottom" as used herein means in the lowest position, e.g., closest the ground. For example, a cylindrical object, e.g., valve body, valve stem, nozzle, tube, cylindrical wall, housing, tubular, and/or a spout assembly, may have a top portion and a bottom portion.

The term "wall" as used herein is defined as any fully solid or partially solid structure having a planar surface. A wall may have two opposing sides. A wall may be a flat plate, e.g., disc. A wall may be cylindrical. A wall may be continuous. A wall may have curved planar sides that may or, in some cases, may not be parallel to one another. A wall may be rigid. A wall may be flexible. A wall may be planar. A wall may be curved. A wall may be cylindrical. A valve body may have a wall. A wall may have one or more grooves. A wall may have one or more ports, e.g., apertures, disposed therethrough. A wall may have one or more grooves disposed therein. A wall may form a flow path configured to receive a valve stem.

3. Certain Specific Embodiments

The disclosure herein includes a spout assembly for pouring liquid fuel, which spout assembly may include a valve body, a valve stem, and a nozzle, wherein: the valve body may include: an air flow housing defining an air flow path; a liquid flow housing defining a liquid flow path; and a valve stem housing that includes a valve stem wall defining a valve stem path, the valve stem wall may include: a liquid port capable of liquid communication with the liquid flow path; and an air port capable of fluid communication with the air flow path; the valve stem may be disposed in the valve stem path, and may include: a first stem flange capable of inhibiting air flow from the air flow path to the valve stem path; a second stem flange capable of inhibiting liquid flow from the liquid flow path to the valve stem path; and the nozzle may be coupled to the valve body.

The disclosure herein includes a spout assembly for pouring liquid fuel, which spout assembly may include a valve body, a valve stem, and a nozzle, wherein: a) the valve body includes a first housing, a second housing, and a valve stem housing; b) the valve stem housing may be disposed between the first housing and the second housing and may include at least one liquid port for passage of liquid fuel between the first housing and the valve stem housing and at least one air port for passage of air between the first housing and the valve stem housing; and c) the valve stem may have a plurality of circumferential grooves, each sized to receive one of the plurality of seals, wherein the seals may be capable of inhibiting the flow of air or liquid within the valve stem housing.

The disclosure herein includes a spout assembly for pouring liquid fuel, which spout assembly may include a valve body, a valve stem, and a nozzle, wherein: a) the valve body may include a first housing, a second housing, and a valve stem housing; b) the valve stem housing may be disposed between the first housing and the second housing and includes at least one liquid port for passage of liquid fuel between the first housing and the valve stem housing and at least one air port for passage of air between the first housing and the valve stem housing; and c) the valve stem may be cylindrical and may include a plurality of valve stem portions including a first narrow valve stem portion and a second narrow valve stem portion, each of the first and second narrow valve stem portions having a diameter that may be less than the diameter of any of the other of the plurality of valve stem portions.

The disclosure herein includes a spout assembly for pouring liquid fuel, which spout assembly may include: a valve body that may include: an air flow path wall defining an air flow path; a liquid flow path wall defining liquid flow path; and a valve stem wall defining a valve stem flow path, the valve stem wall may include: a liquid port in fluid communication with the fluid flow path; and an air port in fluid communication with the air flow path; a valve stem disposed in the valve stem flow path, the valve stem may include: a first stem flange capable of inhibiting fluid flow from the air flow path to valve stem flow path; a second stem flange capable of inhibiting fluid flow from the liquid flow path to valve stem flow path; and a nozzle coupled to the valve body.

The disclosure herein includes a spout assembly for pouring liquid fuel, which spout assembly may include a valve body that may include: an air flow path wall defining an air flow path; a liquid flow path wall defining liquid flow path; and a valve stem wall defining a valve stem flow path, the valve stem wall may include: a liquid port in fluid communication with the fluid flow path; and an air port in fluid communication with the air flow path; a valve stem disposed in the valve stem flow path, the valve stem may include: a first stem groove aligned with the valve stem flow path; a second stem groove aligned with the liquid flow path; an outer nozzle coupled to the valve body; and an inner nozzle disposed in the outer nozzle.

The disclosure herein includes a method of pouring liquid fuel, which method may include: providing a spout assembly that may include a valve body, a valve stem, and a nozzle, wherein: 1) the valve body may include: a) an air flow housing defining an air flow path; b) a liquid flow housing defining a liquid flow path; and c) a valve stem housing that includes a valve stem wall defining a valve stem path, which valve stem wall may include: i) a liquid port capable of liquid communication with the liquid flow path, and ii) an air port capable of fluid communication with the air flow path; 2) the valve stem may be disposed in the valve stem path, and may include: a) a first stem flange capable of inhibiting air flow from the air flow path to the valve stem path; b) a second stem flange capable of inhibiting fluid flow from the liquid flow path to valve stem flow path; and 3) the nozzle may be coupled to the valve body.

The disclosure herein includes a spout assembly for pouring liquid fuel, which spout assembly may include: a valve body that may include: an air flow path wall defining an air flow path; a liquid flow path wall defining liquid flow path; and a valve stem wall defining a valve stem path, the valve stem wall may include: a liquid port in fluid communication with the liquid flow path; and an air port in fluid communication with the air flow path; a valve stem disposed in the valve stem path, the valve stem may include: a first stem groove aligned with the valve stem path; a second stem groove aligned with the liquid flow path; an outer nozzle coupled to the valve body; and an inner nozzle disposed in the outer nozzle.

The disclosure herein includes a method of pouring liquid fuel, which method may include: providing a spout assembly that may include a valve body, a valve stem, and a nozzle, wherein: 1): the valve body may include a first housing, a second housing, and a valve stem housing; 2) the valve stem housing may be disposed between the first housing and the second housing and includes at least one liquid port for passage of liquid fuel between the first housing and the valve stem housing and at least one air port for passage of air between the first housing and the valve stem housing; and 3) the valve stem may have a plurality of circumferential grooves, each sized to receive one of the plurality of seals, wherein the seals are capable of inhibiting the flow of air or liquid within the valve stem housing.

The disclosure herein includes a method of pouring liquid fuel, which method may include: providing a spout assembly that may include a valve body, a valve stem, and a nozzle, wherein: 1) the valve body may include a first housing, a second housing, and a valve stem housing; 2) the valve stem housing may be disposed between the first housing and the second housing and includes at least one liquid port for passage of liquid fuel between the first housing and the valve stem housing and at least one air port for passage of air between the first housing and the valve stem housing; and 3) may be cylindrical and may include a plurality of valve stem portions including a first narrow valve stem portion and a second narrow valve stem portion, each of the first and second narrow valve stem portions having a diameter that may be less than the diameter of any of the other of the plurality of valve stem portions.

The disclosure herein includes a method of pouring liquid fuel, which method may include: providing a spout assembly, which valve body may include: an air flow path wall defining an air flow path; a liquid flow path wall defining liquid flow path; and a valve stem wall defining a valve stem path, the valve stem wall may include: a liquid port in fluid communication with the liquid flow path; and an air port in fluid communication with the air flow path; a valve stem disposed in the valve stem path, the valve stem may include: a first stem groove aligned with the valve stem path; a second stem groove aligned with the liquid flow path; an outer nozzle coupled to the valve body; and an inner nozzle disposed in the outer nozzle.

In any one of the methods or structures disclosed herein, the liquid flow path within the liquid housing may have a direction that is perpendicular to the valve stem path.

In any one of the methods or structures disclosed herein, the liquid flow path within the liquid housing may be parallel to the air flow path within the air housing.

In any one of the methods or structures disclosed herein, the valve stem may be perpendicular to the liquid flow path.

In any one of the methods or structures disclosed herein, the valve stem may further include a stem groove capable of being aligned with the air flow path such that when the valve stem is in a first position, air would be capable of flowing from the air housing to the stem groove, and when the valve stem is in a second position, air would be incapable of flowing from the air housing to the stem groove.

In any one of the methods or structures disclosed herein, the valve stem may further include a stem groove capable of being aligned with the liquid flow path such that when the valve stem is in a first position, liquid would be capable of flowing from the liquid housing to the stem groove, and when the valve stem is in a second position, liquid would be incapable of flowing from the air housing to the stem groove.

In any one of the methods or structures disclosed herein, the valve stem is slidably coupled to an inner wall of the valve stem housing.

Any one of the methods or structures disclosed herein may further include a coil or spring capable of pushing against the valve stem.

Any one of the methods or structures disclosed herein may further include a lever capable being pressed against the valve stem.

Any one of the methods or structures disclosed herein may further include a lock capable of being abutted against the valve body.

Any one of the methods or structures disclosed herein may further include a lock may be capable of inhibiting a lever from being pressed against the valve stem.

In any one of the methods or structures disclosed herein, when the valve stem is in an open position: (a) the first narrow valve stem portion would be aligned with the air port so that air can pass from the first housing through the valve stem housing and to the second housing; and (b) the second narrow valve stem portion would be aligned with the liquid port so that liquid can pass from the first housing through the valve stem housing and to the second housing.

In any one of the methods or structures disclosed herein, the first stem groove may be capable of receiving air from the air flow path.

In any one of the methods or structures disclosed herein, the second stem groove may be capable of receiving liquid from the liquid flow path.

In any one of the methods or structures disclosed herein, the first stem groove may be capable of receiving fluid from the outer nozzle.

In any one of the methods or structures disclosed herein, the inner nozzle may be capable of receiving fluid from the second stem groove.

4. Specific Embodiments in the Drawings

The drawings presented herein are for illustrative purposes only and do not limit the scope of the claims. Rather, the drawings are intended to help enable one having ordinary skill in the art to make and use the claimed inventions.

This section addresses specific versions of spout assemblies shown in the drawings, which relate to assemblies, elements and parts that can be part of a spout assembly, and methods for methods for pouring fluid. Although this section focuses on the drawings herein, and the specific embodiments found in those drawings, parts of this section may also have applicability to other embodiments not shown in the drawings. The limitations referenced in this section should not be used to limit the scope of the claims themselves, which have broader applicability.

Figure 1B:
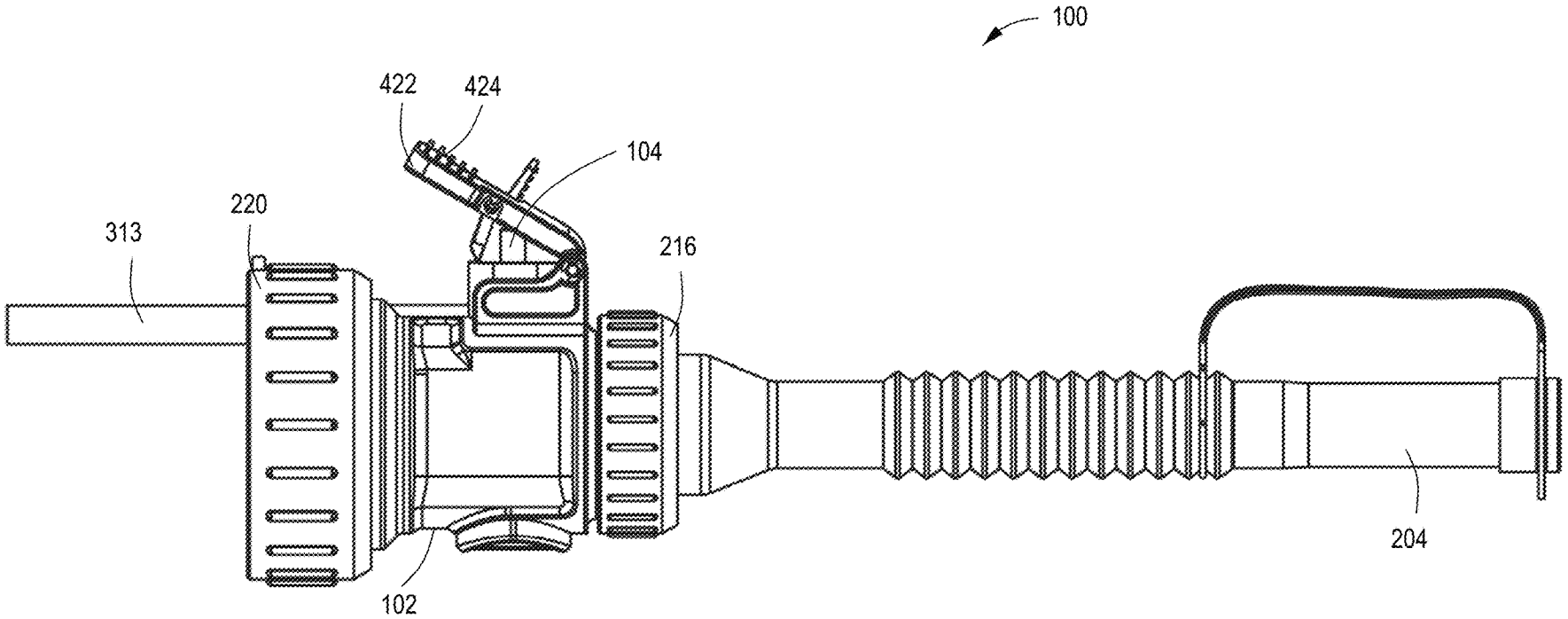
FIG. 1B illustrates a side view of an assembled spout assembly.

FIG. 1A illustrates an exploded view of a spout assembly 100. FIG. 1B illustrates a view of an assembled spout assembly 100.

Referring to FIGS. 1A-B, a spout assembly 100 may include a valve body 102, a valve stem 104, an inner nozzle 202, outer nozzle 204, a nozzle cap 216, a lever 422, a lock 424, and a tank cap 220. Assembly and relationships of the components of the spout assembly 100 are discussed further below.

Once assembled, the spout assembly may be coupled to a tank (not shown) via the tank cap. The tank cap 220 may be cylindrical. The tank cap 220 may have an inner surface and an outer surface. Accordingly, the tank cap 220 may receive an end of a valve body 102. The end of a valve body 102 may have a seal disposed around the end. The tank cap 220 may have a collar capable of being abutted against the seal. Accordingly, in some cases, the tank cap 220 may not be uncoupled from the valve body 102.

In addition, the inner surface of the tank cap 220 may have inner threads disposed thereon. The inner threads may be threadably coupled to outer threads on a tank opening portion of a tank. The tank opening portion may be abutted against the seal. Thus, in some cases, when the opening portion and seal are abutted, fluid may not leak through the seal.

Figure 2:
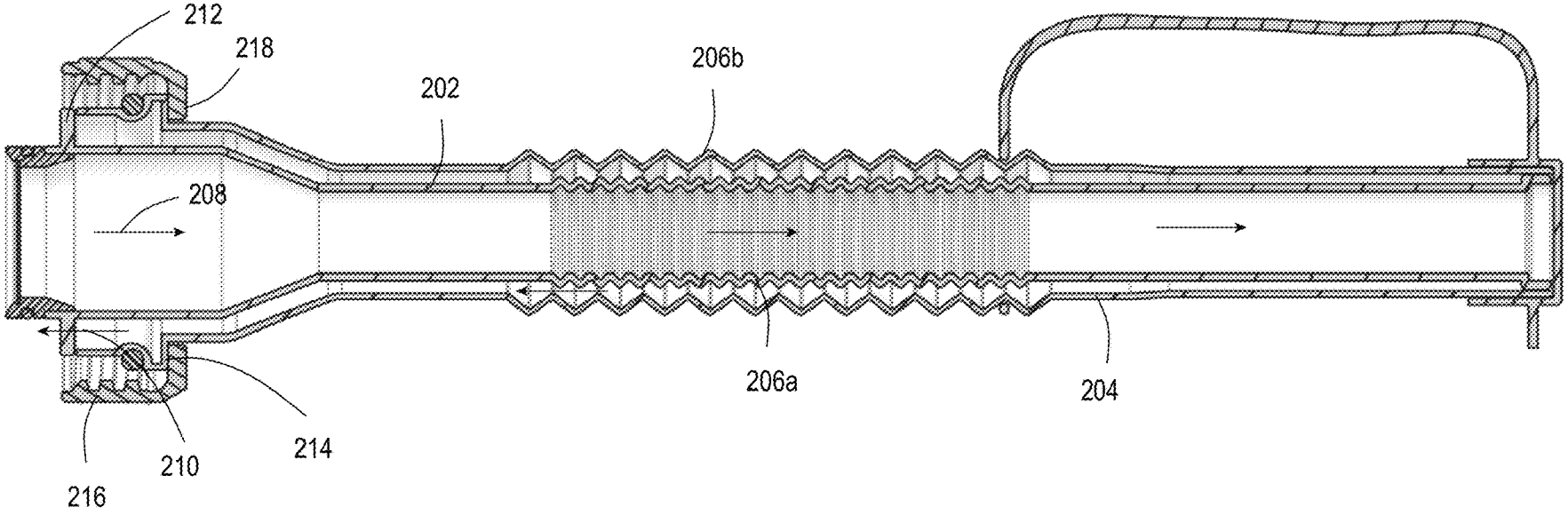
FIG. 2 illustrates a cross-sectional side view of an inner nozzle and an outer nozzle.

FIG. 2 illustrates an inner nozzle 202 and an outer nozzle 204. The inner nozzle 202 and the outer nozzle 204 may both be cylindrical. The inner nozzle 202 and the outer nozzle 204 may both be bendable. The inner nozzle 202 and the outer nozzle 204 may both have respective corrugated portions 206*a*, 206*b*. The inner nozzle 202 and the outer nozzle 204 may be bent at the respective corrugated portion 206*a*, 206*b*. Ridges on the corrugated portion 206*a* may be smaller than ridges on the corrugated portion 206*b*.

Because the inner nozzle 202 may be cylindrical, the inner nozzle 202 may have a nozzle liquid flow path 208 disposed thereon.

The inner nozzle 202 may have a diameter smaller than a diameter of the outer nozzle 204. Thus, the inner nozzle 202 may be disposed concentrically within the outer nozzle 204. The inner nozzle 202 and the outer nozzle 204 may share a central axis. Moreover, a nozzle air flow path 210 may be defined by an outer surface of the inner nozzle 202 and an inner surface of the outer nozzle 204.

The inner nozzle 202 may have a first inner nozzle end having an inner nozzle flange 212 extending radially therefrom. The inner nozzle flange 212 may be abutted against a first outer nozzle end of the outer nozzle 204. Thus, the inner nozzle 202 may extend through the outer nozzle 204; however, the inner nozzle flange 212, in some cases, may inhibit the inner nozzle 202 from being passed completely through the outer nozzle 204.

The first inner nozzle end of the inner nozzle 202 and the first outer nozzle end of the outer nozzle 204 may be coupled to a nozzle end of a valve body 102. The first outer nozzle end may have an outer nozzle flange 214 abutted against the nozzle end of the valve body 102. A nozzle cap 216 may be threadably coupled to the nozzle end of the valve body 102. The nozzle cap 216 may have a nozzle cap flange 218 abutted against the outer nozzle flange 214. The nozzle cap flange 218 may press against the outer nozzle flange 214 to be sealingly coupled to the nozzle end of a valve body 102 (see FIG. 1B).

Figure 3A:
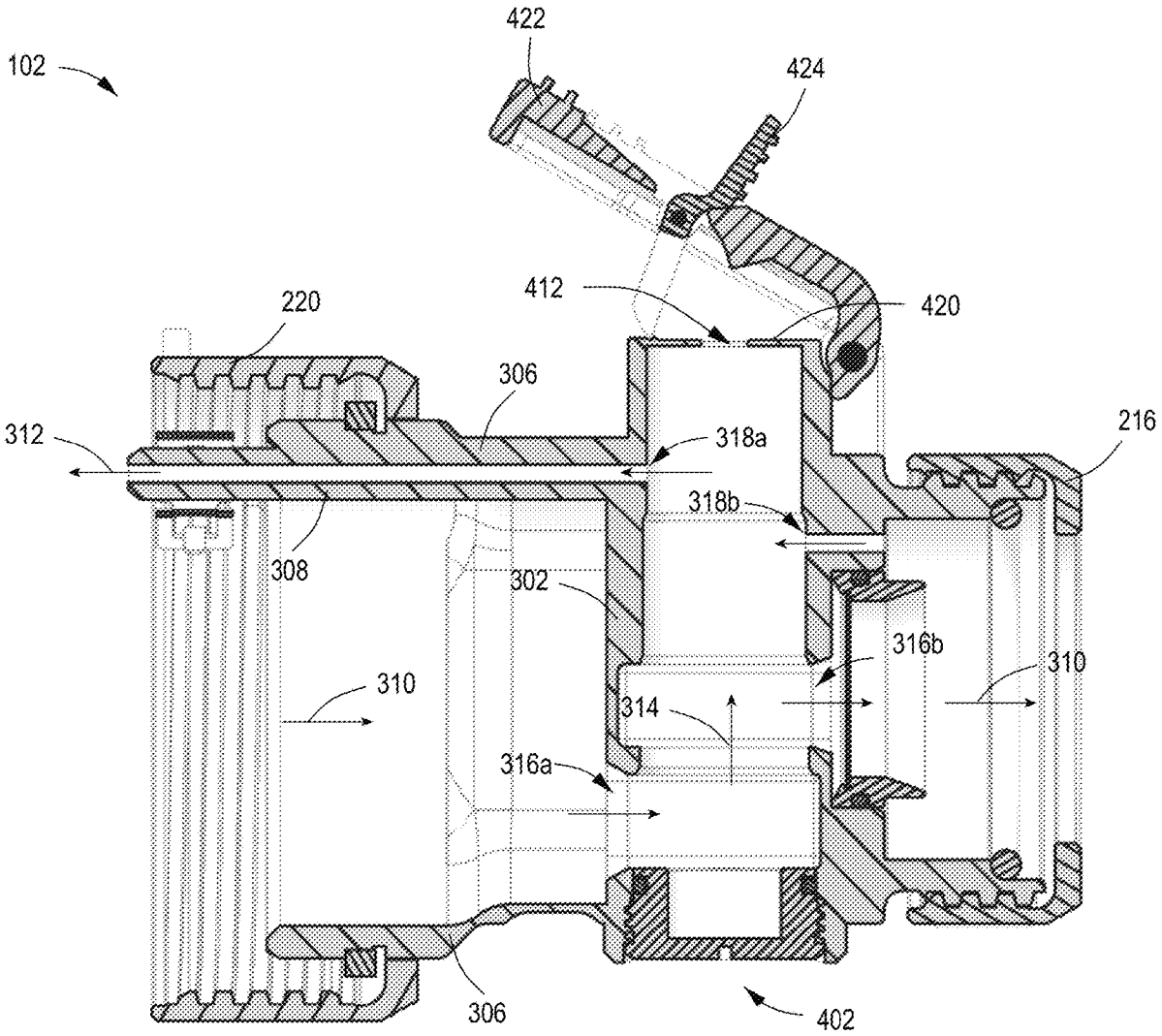
FIG. 3A illustrates a cross-sectional side view of a valve body and a valve stem.
Figure 3B:
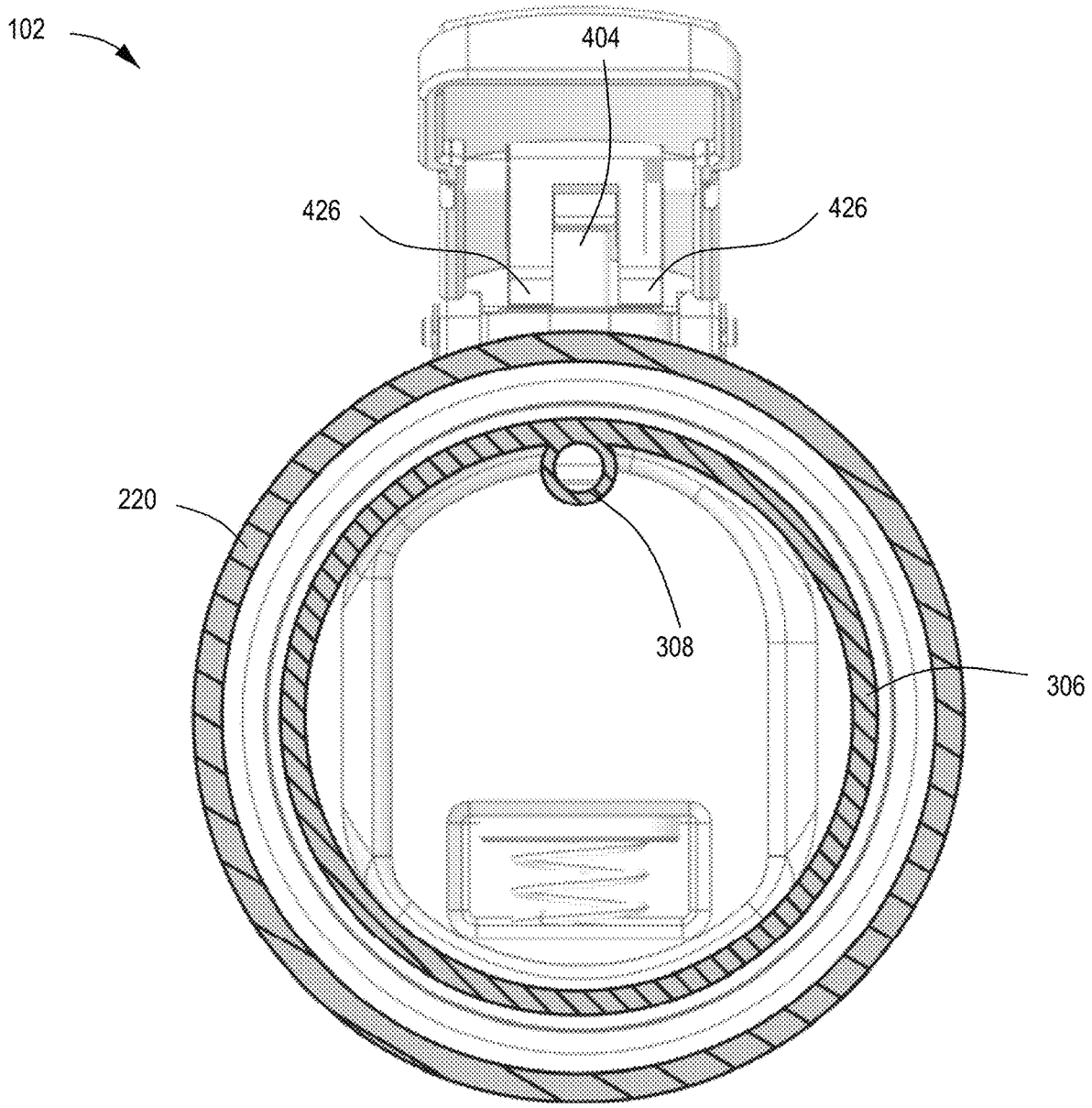
FIG. 3B illustrates a cross-sectional profile view of a valve body, air flow path, and tank cap.

FIG. 3A illustrates a cross-sectional side view of a valve body 102. FIG. 3B illustrates a cross-sectional profile view of a valve body 102, air flow path 308, and tank cap 420.

Referring to FIGS. 3A-B, a valve body 102 may have one or more outer surfaces and one or more inner surfaces. The valve body 102 includes a first housing that includes walls 306 with surfaces that define a liquid flow path and walls 308 with surfaces that define an air flow path. The valve body 102, the liquid flow path walls 306, and the air flow path walls 308 may be unitary, e.g., formed from a single molded piece. The surfaces of the liquid flow path walls 306 may define a liquid flow path 310 in the first housing, and as seen in FIG. 3B the inner surfaces of walls 306 are cylindrical so that the liquid flow path is also cylindrical and has a horizontal axis pointed into the page, and the walls 308 that define an air flow path are disposed within the space formed by the walls 306, and that air flow path is also cylindrical with a horizontal axis pointed into the page. The air flow path wall 308 may have surfaces that define an air flow path 312 in the first housing. The air flow path 312 and the liquid flow path 310 as seen in FIGS. 3A-B have parallel central axes in the first housing. The air flow path wall 308 with cylindrical surfaces that define an air flow path may be part of an air tube 313 which may be coupled, e.g., via a clamp, to the first housing, and may extend into a tank (not shown).

In addition, at least some of the inner surfaces of the valve body 102 may have valve stem walls 302, which may be part of a valve stem housing and define a valve stem path. The valve stem walls 302 may extend at least from an air port, where air is capable of entering the valve stem housing, to a liquid port, where liquid is capable of entering the valve stem housing. The valve body 102, the fluid flow path wall 306, the air flow path wall 308, and the valve stem wall 302 may be unitary. The valve stem wall 302 may be also be cylindrical. Accordingly, the valve stem wall 302 may define a valve stem path 314.

The valve stem path 314 may have a central axis perpendicular to both the central axes of the liquid flow path 310 and of the air flow path 312. Thus, the valve stem path 314 may be in fluid communication with the liquid flow path 310, the air flow path 312, and a nozzle liquid flow path 208 of an inner nozzle 202 (see FIG. 2).

The valve stem housing 303 may include a first liquid port 316*a* and second liquid port 316*b* extending through the valve stem wall 302 of the housing 303 on either side of the housing 303. The first liquid port 316*a* may be open to the liquid flow path 310. Accordingly, liquid may be communicated from the liquid flow path 310 into the valve stem path 314 through the first liquid port 316*a*. The second liquid port 316*b* may be open to a nozzle liquid flow path 208 (see FIG. 2). Accordingly, liquid may be communicated from valve stem path 314 into the nozzle air flow path 208 through the second liquid port 316*b*.

The valve stem wall 302 may have a first air port 318*a* and second air port 318*b* extending therethrough. The first air port 318*a* may be open to the air flow path 312. Accordingly, air may be communicated from the air flow path 312 into the valve stem path 314 through the first air port 318*a*. The second air port 318*b* may be open to the nozzle air flow path 210. Accordingly, air may be communicated from the valve stem path 314 into the nozzle air flow path 210 through the second air port 318*b*.

Figure 4A:
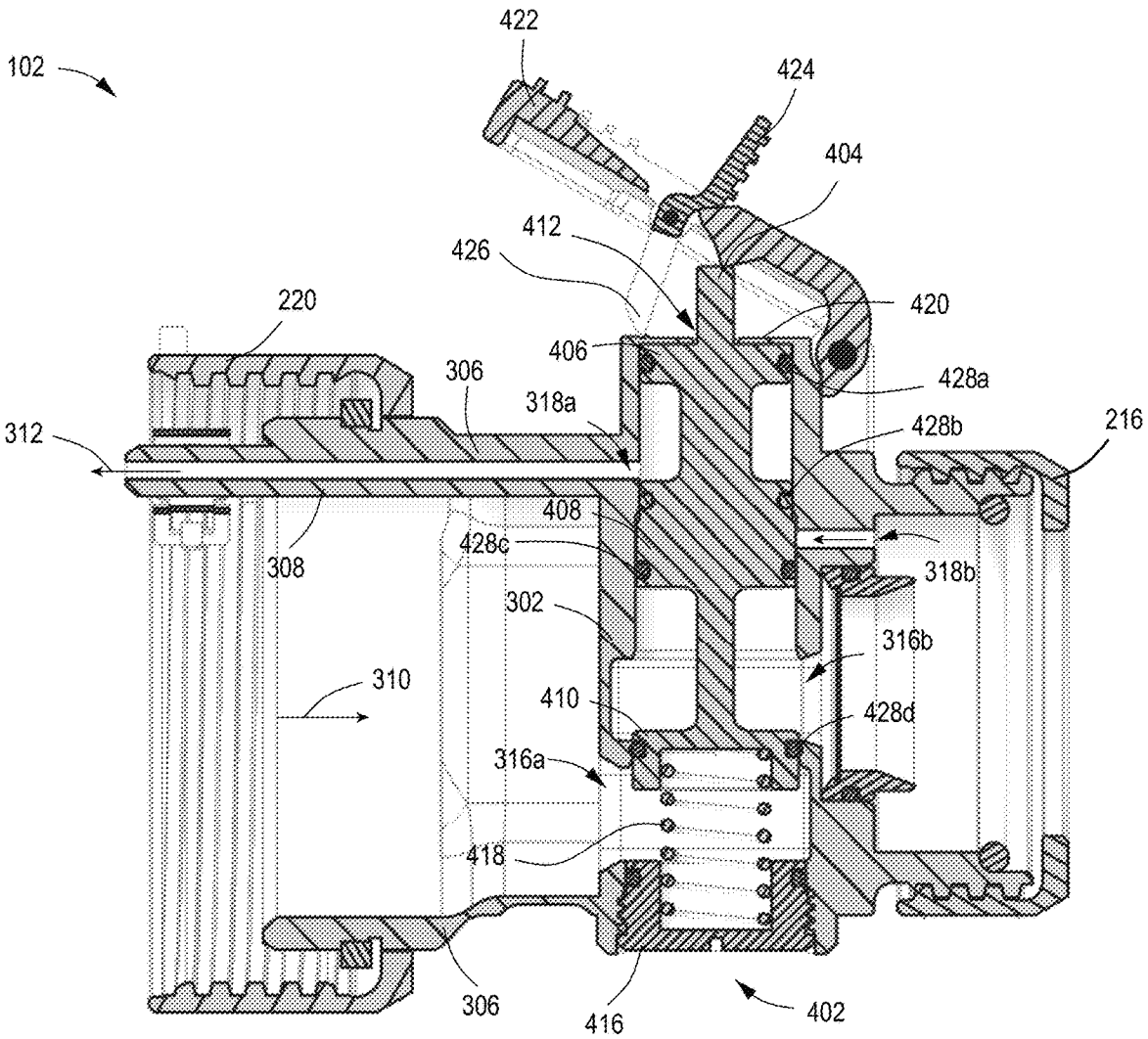
FIG. 4A illustrates a cross-sectional side view of a valve body and a valve stem in a closed position.
Figure 4B:
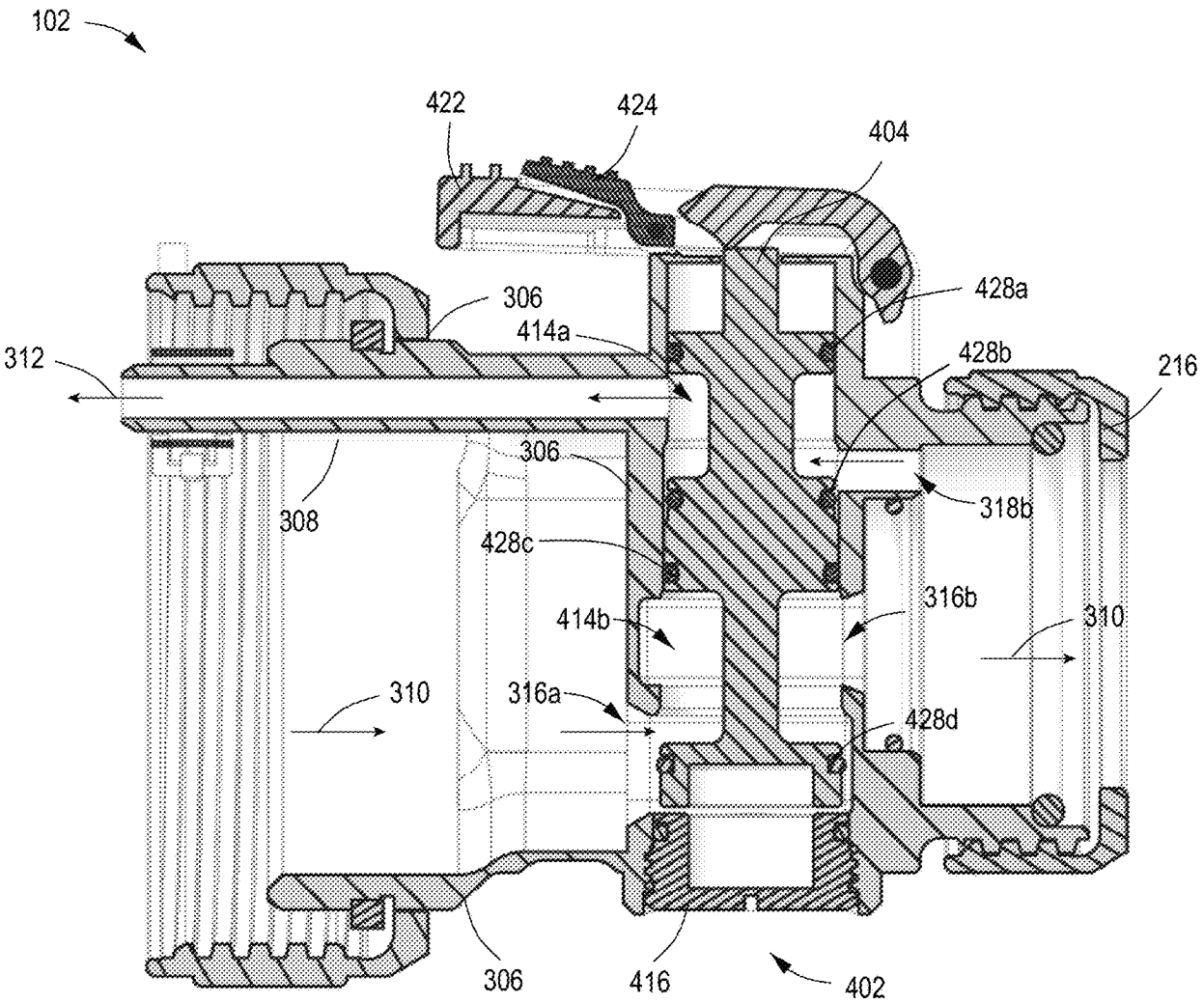
FIG. 4B illustrates a cross-sectional side view of a valve having a valve body and a valve stem in an open position.

FIG. 4A illustrates a cross-sectional side view of a valve body 102 and a valve stem 104 in a closed position. FIG. 4B illustrates a cross-sectional side view of a valve body 102 and a valve stem 104 in an open position.

Referring to FIGS. 4A-B, a valve stem 104 may be disposed with a cylindrical valve stem wall 302 of a valve body 102. In other words, the valve stem 104 may be disposed in a valve stem path 308. The valve stem 104 may be slid through a valve stem opening 402 of the valve body 102 (see FIG. 3A). The valve stem 104 may have a trigger end 404, a first stem flange 406, a second stem flange 408, and a third stem flange 410. The trigger end 404 may protrude from the first stem flange 406. The trigger end 404 may extend through a trigger aperture 412 disposed in the valve body 102.

The first stem flange 406, the second stem flange 408, and the third stem flange 410 may be axially spaced apart from each other on and as part of the valve stem 104. Accordingly, a first circumferential groove 414*a* may be defined between the first stem flange 406 and the second stem flange 408. Air may be communicated from a nozzle air flow path 210 through the first circumferential groove 414*a* into the air flow path 312 in the valve body 102. Additionally, a second circumferential groove 414*b* may be defined between the second stem flange 408 and the third stem flange 410. The second circumferential groove 414*b* may aligned with a first liquid port 316*a* and with a second liquid port 316*b* disposed through a valve stem wall 302 (see FIG. 4A). Accordingly, liquid may be communicated from a nozzle liquid flow path 208 through the second circumferential groove 414*b* into the liquid flow path 310 in the valve body 102.

The first stem flange 406, the second stem flange 408, and the third stem flange 410 may each have respective seals 422*a-d* disposed around a radial surface thereof. The seals 422*a-c* may be abutted against one of the valve stem walls 302 of the valve stem housing. In some cases, the seals 422*a-d* may inhibit air and/or liquid from being communicated between the first circumferential groove 414*a* and the second circumferential groove 414*b*. For example, in some cases, a first seal 422*a* disposed around the first stem flange 406 may inhibit air and/or liquid from leaking above the first stem flange 406. The second seal 422*b* and the third seal 422*c* disposed around the second stem flange 408 may, in some cases, inhibit air and/or liquid from leaking below the second stem flange 408. The third seal 422*c* disposed around the third stem flange 410 may, in some cases, inhibit air and/or liquid from leaking below the third stem flange 410.

A valve stem cap 416 may threadably extend through the valve stem opening 402. A seal may be disposed around a radial surface of the valve stem cap 416. The seal may be abutted against an inner surface of the valve body 102 that defines the valve stem opening 402. Accordingly, the seal and the cap, in some cases, may inhibit fluid and/or debris from entering and/or exiting the valve stem opening 402.

A spring 418 may be disposed between the valve stem cap 416 and the third stem flange 410 of the valve stem 104. The spring 418 may be abutted against both the valve stem cap 416 and the third stem flange 410. The spring 418 may push against the third stem flange 410. Accordingly, the spring 418 may push the valve stem 104 towards a collar 420 of the valve body 102. The collar 420 may define the trigger aperture 412 through which the trigger end 404 of valve stem 104 extends. The first stem flange 406 may be abutted against the collar 420. In some cases, the collar 420 may inhibit upward movement of the valve stem 104.

A lever 422 may be used to push the valve stem 104 against the upward bias of the spring 418. The lever 422 may have a first end rotatably coupled, e.g., a pin, to an outer surface of the valve body 102. The lever 422 may have a portion abutted against the trigger end 404 of the valve stem 104. When downward force (greater than force exerted by the spring 418) is applied to the lever 422, the downward force would cause the lever 422 to push the valve stem 104 downward.

In some cases, referring to FIG. 4A, a lock 424 may inhibit the lever 422 from being pushed downward. The lock 424 may extend through the lever 422. The lock 422 may have a middle lock portion rotatably coupled to the lever 422. The middle lock portion may be coupled via a pin to the lever 422. A coil (not shown) may be coupled to the pin. The coil may have a first end abutted against the lock 424 and a second end abutted against the lever 422. Accordingly, the coil may bias the lock 424 to be positioned (in a locked position) at an obtuse angle, e.g., 90 degrees or greater, to the lever 422.

In addition, in the locked position, the lock 424 may have a first lock end 426 abutted against the collar 420 of the valve body 102. Accordingly, in some cases, when the lever 422 is pressed, e.g., by a human finger, the first lock end 426 of the lock 424 may inhibit the pressed lever 422 from moving downward. When the lock 424 is in the locked position, the valve stem 104 would be a closed position.

In the closed position, the second stem flange 408 may be aligned with, e.g., adjacent, a first air port 318*a*. The assembly 102 preferably includes a plurality of seals 428*a-d*, which are preferably positioned in stem grooves disposed circumferentially in the stem flanges 408*a-c*. The stem grooves may be shaped and sized to receive the seals 428*a-d*. The seals 428*a-d* may be cylindrical, e.g., they have a circular shape, and are preferably O-rings. The seal 428*b* may be disposed above the first air port 318*a* and the seal 428*c* may be disposed below the first air port 318*a* so that they prevent air from leaking upward or downward through the annular space between the inner walls of the valve stem housing and the outer walls of the valve stem. The seals 428*b-c* may be abutted against the valve stem wall 302. Thus, in some cases, the second stem flange 406 and the seals 428*b-c* may inhibit air flow between an air flow path 312 and a nozzle air flow path 210.

Additionally, in the closed position, the third flange 410 may be disposed above a first liquid port liquid port 316*a* and below a second liquid port 316*b*. The seal 428*d* (disposed around the third stem flange 410 may be abutted against the valve stem wall 302. Thus, in some cases, the third stem flange 408 and the seal 428*d* may inhibit liquid flow between a liquid flow path 310 and a nozzle liquid flow path 208.

Referring to FIG. 4B, the valve stem 104 may be slid to an open position if the lock 424 is moved to an unlocked position. Accordingly, the lock 424 may lay parallel to the lever 422. In some cases, the lock 424 may not be abutted against the valve body 102. The lever 422 may have a portion pushed against the valve stem 104. The pushed valve stem 104 be disposed in an open position relative to the valve body 102.

Figure 5A:
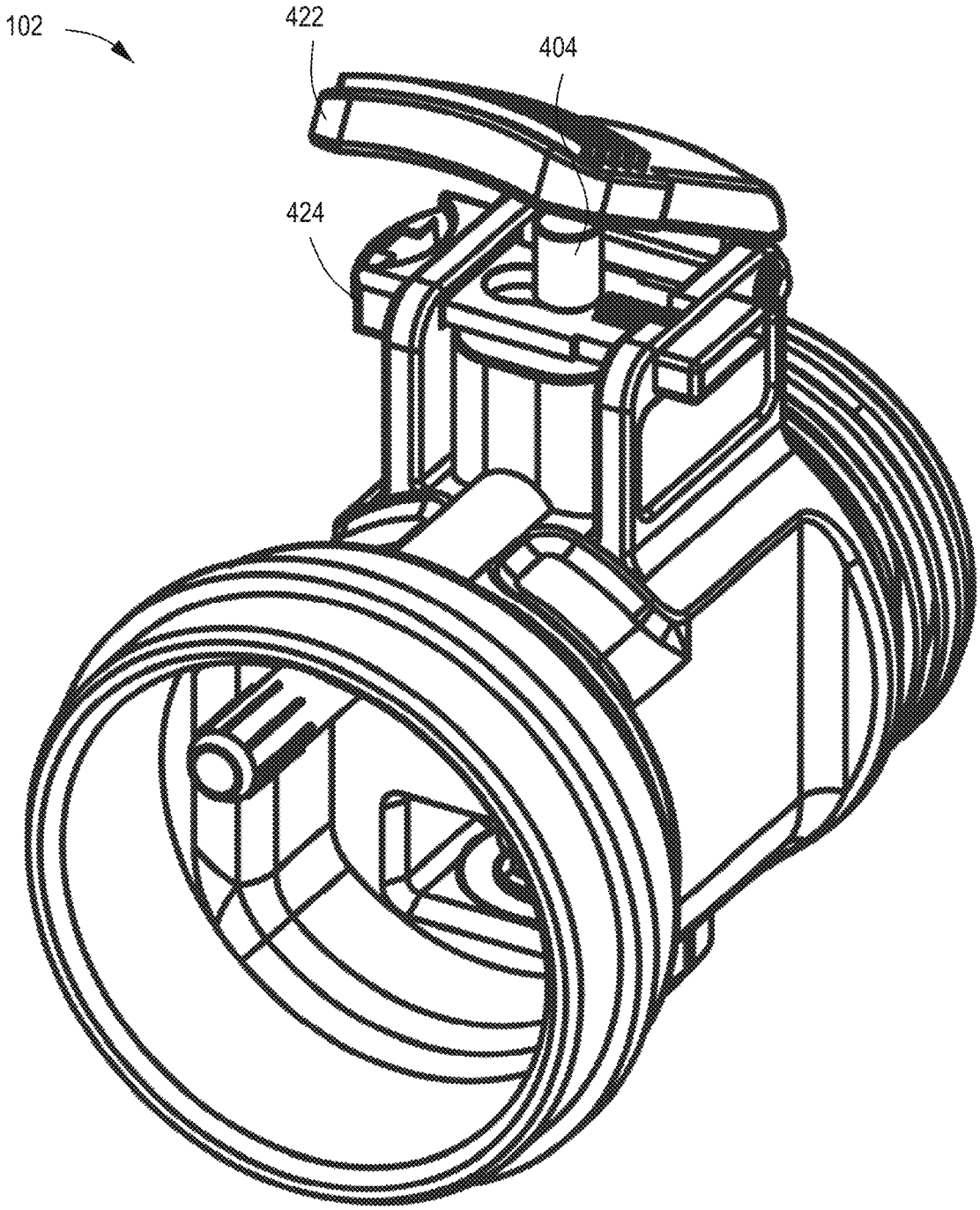
FIG. 5A illustrates a perspective view of a body, a valve stem, and an alternate lock.
Figure 5B:
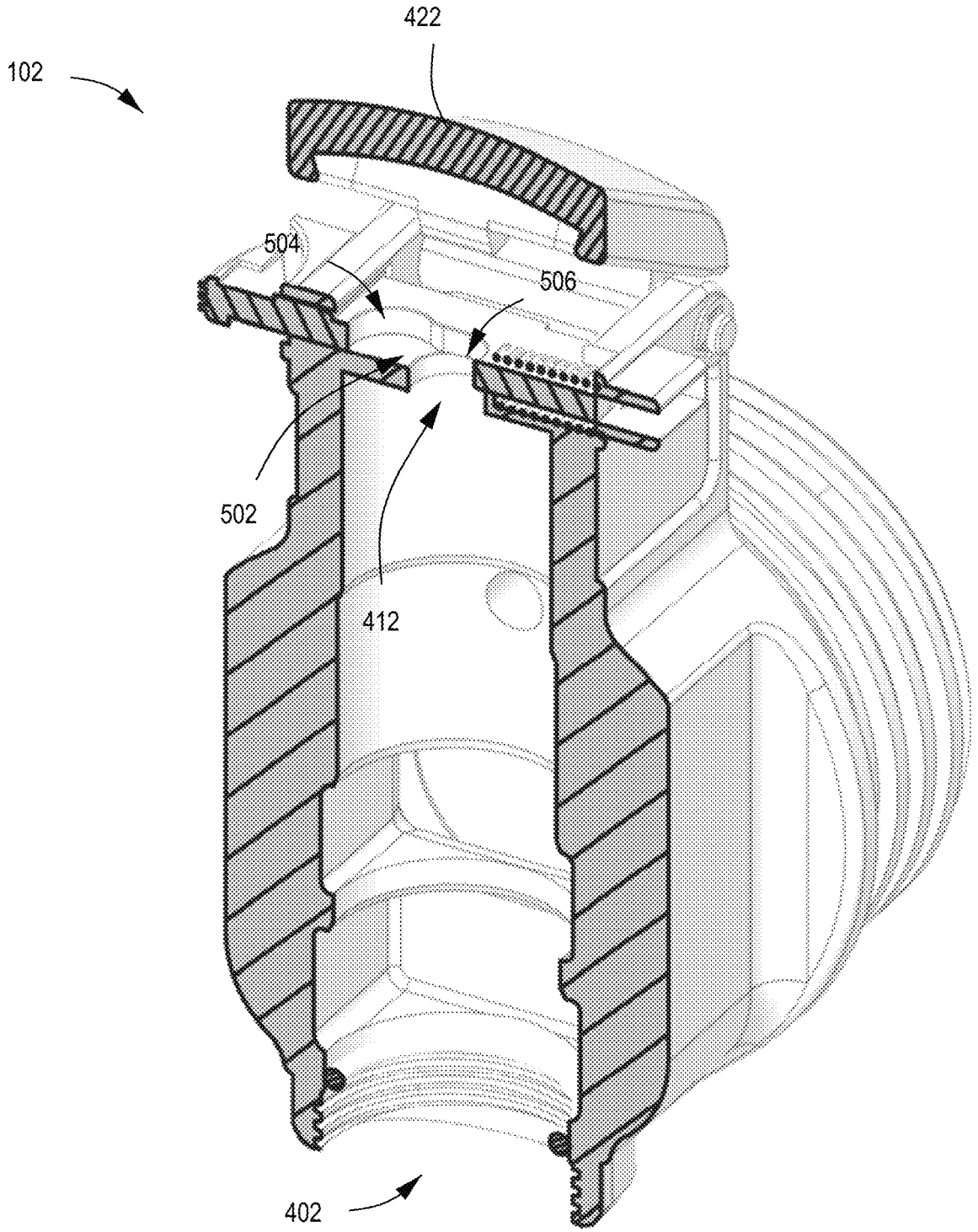
FIG. 5B illustrates a cross-cut view of a valve body and an alternate lock slidably coupled thereto.
Figure 5C:
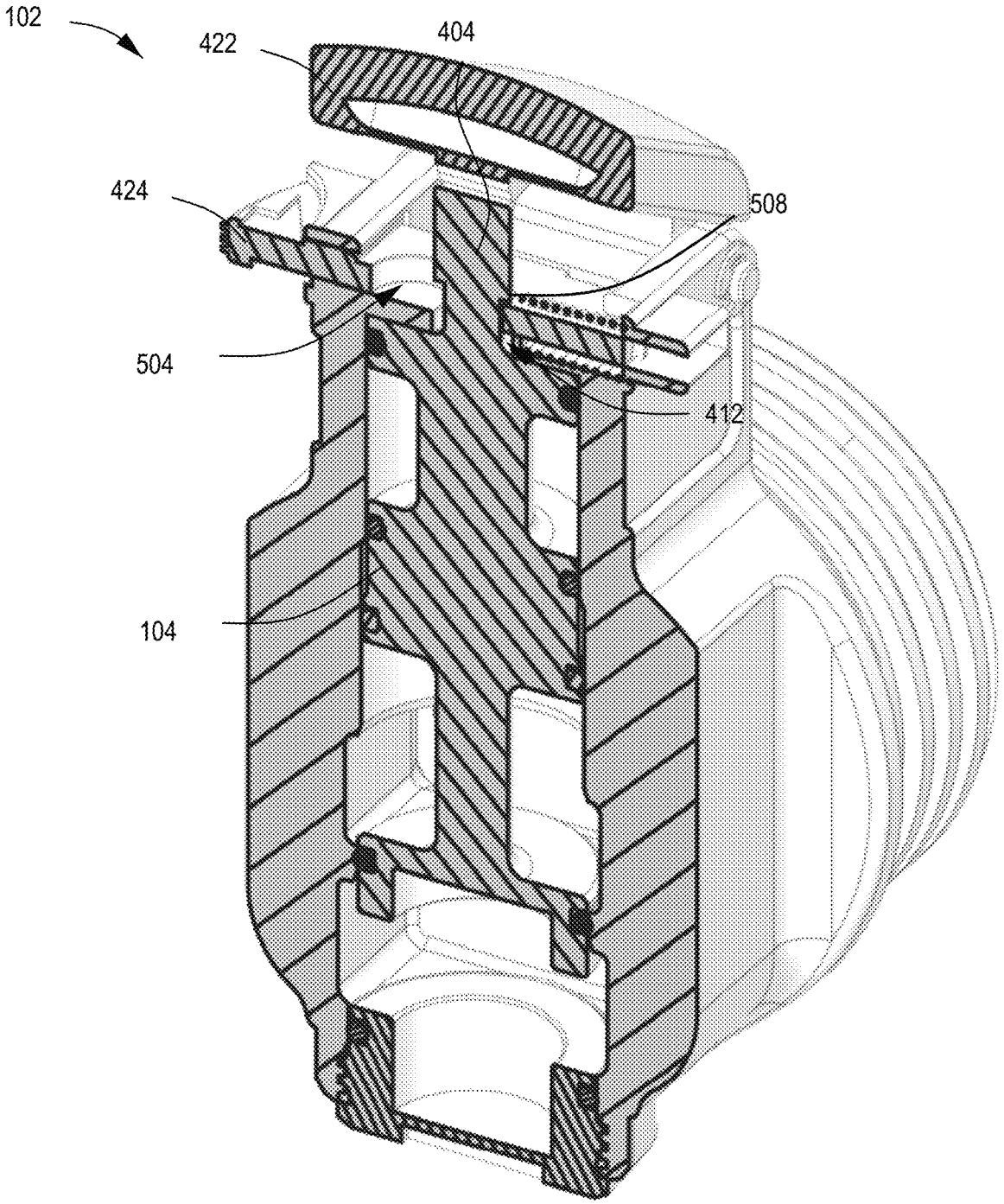
FIG. 5C illustrates a cross-cut view of a valve body, a valve stem, and an alternate lock in a closed position.
Figure 5D:
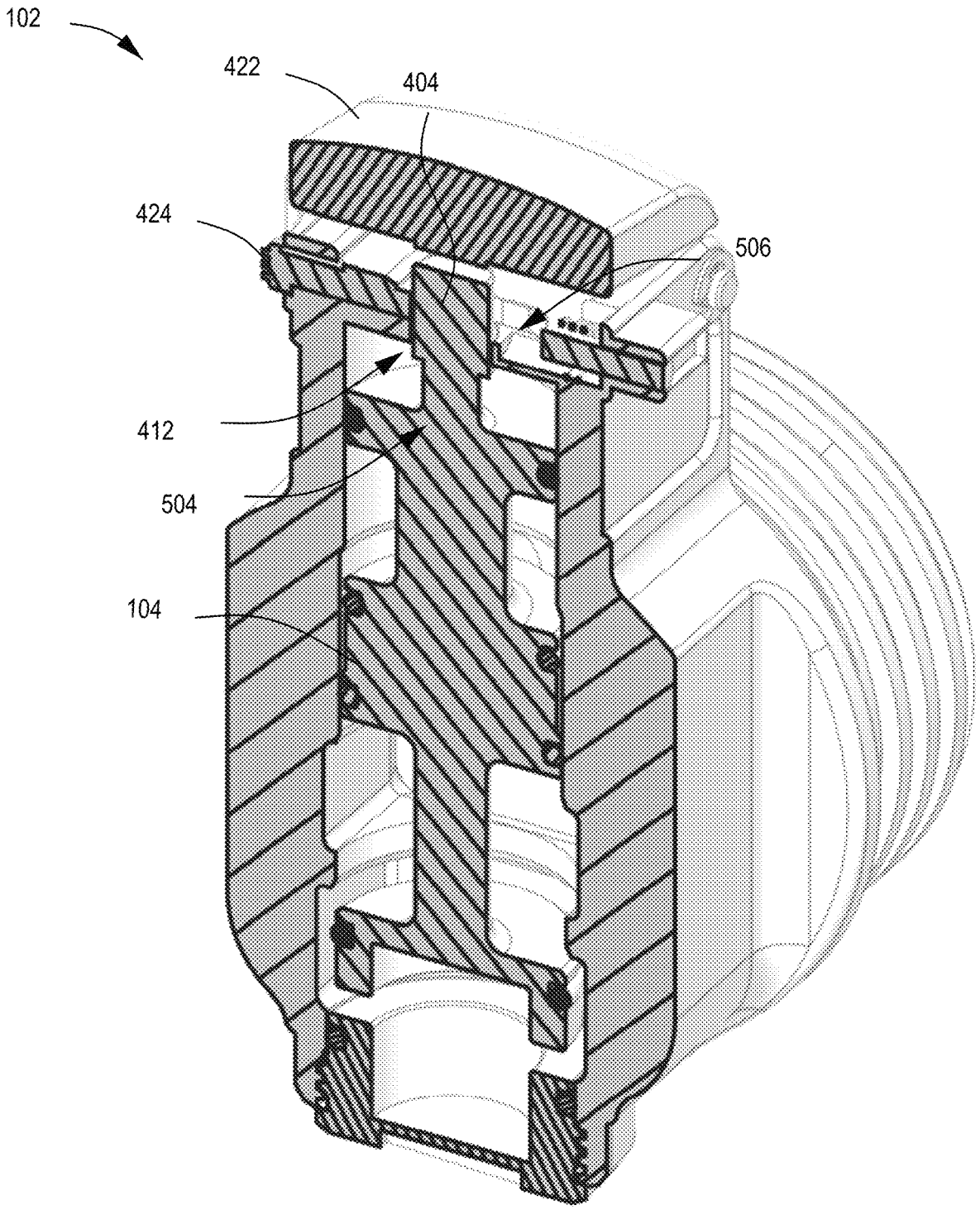
FIG. 5D illustrates a cross-cut view of a valve body, a valve stem, and an alternate lock in an open position.

FIG. 5A illustrates a perspective view of a body 102, a valve stem 104, and an alternate lock 424. FIG. 5B illustrates a cross-cut view of a valve body 102 and an alternate lock 424 slidably coupled thereto. FIG. 5C illustrates a cross-cut view of a valve body 102, a valve stem 104, and an alternate lock 424 in a closed position. FIG. 5D illustrates a cross-cut view of a valve body 102, a valve stem 104, and an alternate lock 424 in an open position.

Referring to FIGS. 5A-D, a lock 424 may permit or, in some cases, inhibit pushing of the lever 422. The lock 424 be slidable coupled to the valve body 102. The lock 424 may be a flat plate. The lock 424 may have a lock aperture 502. The lock aperture 502 may be a first aperture portion 504 and a second aperture portion 506. A first inner surface portion of the lock 424 may defining the first aperture portion 504. The first inner surface portion of the lock 424 may have a first diameter. A second inner surface portion of the lock 424 may define the second aperture portion 506. The second inner surface portion may have a second diameter. The first diameter may be larger than the second diameter. A portion of the valve stem 104 may be disposed in the lock aperture 502. A portion of the valve stem 104 may be capable of being slid through the lock aperture 502.

Referring to FIG. 5C, in a locked position, the second aperture 506 of the lock 424 may be aligned with the second aperture portion 506 and the trigger end 404 of the valve stem 104. A shoulder 508 of the trigger end 404 of the valve stem 104 may be abutted against an upper surface of the lock 424. Thus, in some cases, the lock 424 may inhibit pushing of the lever 422 downward. Accordingly, in some cases, when the lever 422 is pressed, e.g., by a human finger, the lock 424 may inhibit the pressed lever 422 from moving downward. When the lock 424 is in the locked position, the valve stem 104 would be a closed position.

Referring to FIG. 5D, in an unlocked position, the first aperture 504 of the lock 424 may be aligned with the trigger aperture 412 and the trigger end 404 of the valve stem 104. The trigger end 404 may be slid through first aperture 504 and the trigger aperture 412. In some cases, the lock 424 may not be abutted against the lock 104. Accordingly, in some cases, when the lever 422 is pressed, e.g., by a human finger, the lever 422 would be move downward. When the lock 424 is in the unlocked position, the valve stem 104 would be an open position.

Before using the spout assembly 100 to refill a vehicle with fuel, a user may fill a tank with fuel from an external source, e.g., gas station. Fuel may be pumped into the tank through a tank opening portion of the tank. After filling the tank, the user may threadably couple a tank cap 220 to the tank opening portion. The user may turn the tank cap 220 clockwise until the tank opening portion may be abutted against a seal disposed around and end of a valve body 102 of the spot assembly 100. Furthermore, the tank opening portion may be abutted against a collar. Accordingly, in some case, the seal may inhibit fuel from leaking through the seal.

To refill a vehicle with fuel using the spout assembly 100, the user may insert the concentric nozzles 202, 204 of the spout assembly 100 into a gas port of the vehicle.

The spout assembly 100 may have valve body 102, a lever 422, and a lock 424. The lock 424 may be rotatably coupled to the lever 422. In a locked position, the lock 424 may be abutted against an outer surface, e.g., collar 420, of the valve body 102. Accordingly, when the user presses on the lever 422, while the lock 424 is abutted against the valve body 102, the lever 422 would, in some cases, be inhibited from moving.

In an unlocked position, the lock 424 may lay parallel to the lever 422 and, in some cases, may not abutted to the valve body 102. Accordingly, when the user presses on the lever 422, while the lock 424 is not abutted against the valve body 102, the lever would be moved relative to the valve body 102.

To move the lock 424 to the unlocked position, the user (using a finger) may press on the lock 424, causing the lock 424 to lay parallel to the lever 422. Accordingly, in some cases, the lock 424 may not be abutted against the valve body 102. While holding the lock 424 parallel against the lever 422, the user (with the same finger) may press on the lever 422. The pressed lever 422 may pivot towards the valve body 102. The lever 422 may have a portion push against a valve stem 104. The pushed valve stem 104 move downward to an open position.

The valve stem 104 may a first stem flange 406, a second stem flange 408, and a third stem flange 410. The first stem flange 406, the second stem flange 408, and the third stem flange 410 may be axially spaced apart from each other on the valve stem 104. Accordingly, a first circumferential groove 414*a* may be defined between the first stem flange 406 and the second stem flange 408. Additionally, a second circumferential groove 414*b* may be defined between the second stem flange 408 and the third stem flange 410. When the valve stem 104 is in an open position, the first circumferential groove 414*a* would be aligned with a first air port 318*a* and would be aligned with a second air port 318*b* disposed through a valve stem wall 302 in the valve body 102 (see FIG. 4A). Also, the second radial groove 414*b* would be aligned with a first liquid port 316*a* and would be aligned with a second liquid port 316*b* disposed through a valve stem wall 302 (see FIG. 4A).

The user may raise the tank upward so fuel in the tank may flow into a liquid flow path 310 in the valve body 102. The fuel may flow through the first liquid port 316*a*, second circumferential groove 414*b*, the second liquid port 316*b*, and nozzle liquid flow path 208 into the vehicle.

Additional, air may flow through nozzle air path 210, the second air port 318*b*, the first circumferential groove 414*a*, the first air port 318*a*, the air flow path 312, and an air tube 313 into the tank.

Movement of air into the tank, in some cases, may inhibit creation of a vacuum inside the tank. In some cases, a vacuum inside the tank may inhibit fuel from flowing out of the tank. Thus, air introduced into the tank would facilitate pouring of fuel from the tank.

After filling the vehicle with fuel from the tank, the user may remove his/her finger from the lever 422 and the lock 424. A spring 418 may push the valve stem 104, e.g., via the third stem flange 410, causing the valve stem 104 to move to a closed position. In the closed position, the second stem flange 406 may be aligned with, e.g., adjacent, a first air port 318*a*. Additionally, the seal 428*b* may be disposed above the first air port 318*a* and the seal 428*b* may be disposed below the first air port 318*a*. The seals 428*b-c* may be abutted against the valve stem wall 302. Thus, in some cases, the second stem flange 406 and the seals 428*b-c* may inhibit air flow between an air flow path 312 and a nozzle air flow path 210.

Additionally, in the closed position, the third flange 408 may be disposed above a first liquid port liquid port 316*a* and below a second liquid port 316*b*. The seal 428*d* (disposed around the third stem flange 410) may be abutted against the valve stem wall 302. Thus, in some cases, the third stem flange 408 and the seal 428*d* may inhibit liquid flow between a liquid flow path 310 and a nozzle liquid flow path 208.

What is claimed as the invention is:

1. A spout assembly for pouring liquid, comprising:
- a valve body, comprising:
  - an air flow path wall defining an air flow path;
  - a liquid flow path wall defining a liquid flow path; and
  - a valve stem wall defining a valve stem path, the valve stem wall comprising:
    - a liquid port in fluid communication with the liquid flow path; and
    - an air port in fluid communication with the air flow path;
- a valve stem disposed in the valve stem path, the valve stem comprising:
  - a first stem groove aligned with the valve stem path;
  - a second stem groove aligned with the liquid flow path;
- an outer nozzle coupled to the valve body; and
- an inner nozzle disposed in the outer nozzle, wherein the inner nozzle is capable of receiving fluid from the second stem groove.

2. The spout assembly of claim 1, wherein the first stem groove is capable of receiving air from the air flow path.

3. The spout assembly of claim 1, wherein the second stem groove is capable of receiving liquid from the liquid flow path.

4. The spout assembly of claim 1, wherein the first stem groove is capable of receiving fluid from the outer nozzle.

* * * * *